United States Patent [19]

Perch

[11] 3,990,513

[45] Nov. 9, 1976

[54] METHOD OF SOLUTION MINING OF COAL

[75] Inventor: Michael Perch, Pittsburgh, Pa.

[73] Assignee: Koppers Company, Inc., Pittsburgh, Pa.

[22] Filed: Dec. 19, 1973

[21] Appl. No.: 426,260

Related U.S. Application Data

[63] Continuation-in-part of Ser. No. 272,578, July 17, 1972, abandoned.

[52] U.S. Cl. ..... 166/267; 44/1 B; 166/303; 175/64; 299/4

[51] Int. Cl.[2] ..... E21B 43/25; E21C 41/00

[58] Field of Search ..... 44/1 B; 166/266, 267, 166/271, 272, 303; 208/8; 299/2, 4, 5; 175/64

[56] References Cited

UNITED STATES PATENTS

| | | | |
|---|---|---|---|
| 1,532,826 | 4/1925 | Lessing | 299/5 |
| 2,595,979 | 5/1952 | Pevere et al. | 166/303 |
| 3,010,707 | 11/1961 | Craighead | 166/272 |
| 3,240,566 | 3/1966 | Bullough et al. | 208/8 |
| 3,341,447 | 9/1967 | Bull et al. | 208/8 |
| 3,375,188 | 3/1968 | Bloomer | 208/8 |
| 3,594,304 | 7/1971 | Seitzer et al. | 208/8 |
| 3,645,885 | 2/1972 | Harris et al. | 208/8 |
| 3,726,785 | 4/1973 | Keller et al. | 208/8 |
| 3,766,982 | 10/1973 | Justheim | 166/272 |

OTHER PUBLICATIONS

Van Krevelen, "Coal Constitution and Solvent Extraction," Fuel July 1965, pp. 229–241.

*Primary Examiner*—Ernest R. Purser
*Attorney, Agent, or Firm*—Sherman H. Barber; Olin E. Williams; Oscar B. Brumback

[57] ABSTRACT

A solvent of coal is pumped through pipes drilled into the earth to a coal seam. The coal is digested or dispersed into the solvent and solvent recycle, and is thereafter pumped as a solution up to the surface and processed to remove the coal from the solvent. The method produces low-ash coal, stripped of all the extraneous ash, leaving the inherent ash, and stripped of all the sulfur except the organic type. The method comprises making a coal solution in situ and bringing it to the earth surface economically, without the hazards and environmental problems of conventional coal mining and without the need of coal washing facilities.

10 Claims, 1 Drawing Figure

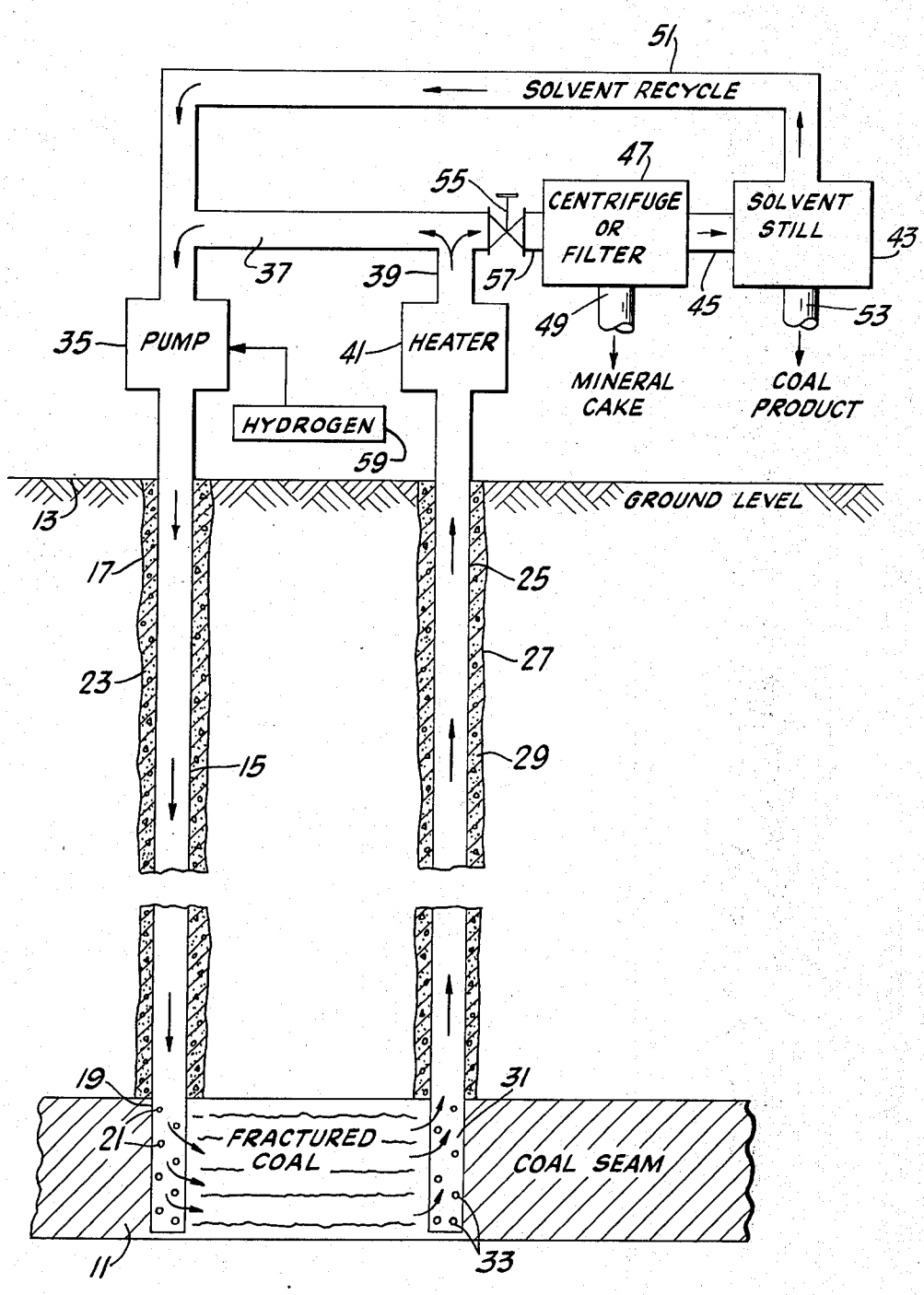
51
SOLVENT RECYCLE
47
55
CENTRIFUGE OR FILTER
SOLVENT STILL
43
37
39
57
45
49
53
35
PUMP
41
HEATER
MINERAL CAKE
COAL PRODUCT
HYDROGEN
59
GROUND LEVEL
13
17
25
27
23
15
29
19
31
21
FRACTURED COAL
COAL SEAM
11
33

METHOD OF SOLUTION MINING OF COAL

CROSS REFERENCE TO RELATED APPLICATIONS

This application is a continuation-in-part of U.S. application Ser. No. 272,578, filed on July 17, 1972 now abandoned.

BRIEF SUMMARY OF THE INVENTION

A coal solvent is injected into a seam of coal and the coal dissolves in the solvent. The coal solution is removed from the seam zone, conveyed to ground level, and is heated. One portion of the heated solution is recycled into the coal seam, and the other portion is processed to separate the coal from the solvent which is recycled to the coal seam.

For a further understanding of the invention and for features and advantages thereof, reference may be made to the following description and to the drawing which illustrates a preferred embodiment of equipment in accordance with the invention which is suitable for practicing the method of the invention.

DETAILED DESCRIPTION

Referring to the drawing, a coal seam 11 is shown at some finite distance beneath the ground level surface 13, and it is desired to extract the coal from the seam, without resorting to conventional shaft mining. In accordance with the method of the invention, a first tubular conduit or casing 15 is installed in a bore-hole 17 in the earth and the lower end portion 19 of the conduit 15 is perforated, as at 21, to allow fluid carried by the conduit to flow therefrom into the coal seam 11.

The tubular conduit or casing 15 is cemented in place, as at 23 in the manner oil-well casing is cemented in place. The tubular conduit or casing 15 is associated with one or, preferably, more similar tubular conduits or casings 25 spaced some distance away from the casing 15 and arranged in a manner disclosed in the prior art.

The tubular conduit or casing 25 is also cemented in a bore-hole 27, as at 29, and its lower end portion 31 is also perforated, as at 33, to admit fluid and coal solution to enter the casing 25.

The conduit or casing 15 is fluidly connected above the gound level surface 13 to the discharge side of a suitable pump 35 which is fluidly connected at its suction side to a conduit 37. The conduit 37 is fluidly connected by means of conduit 39 to a heater 41 of conventional construction that receives fluid and coal solution from the tubular conduit or casing 25, and to a solvent still 43 by means of conduit 45.

The solvent still 43 receives both coal in solution and solvent from a centrifuge or filter 47, which is an optional piece of equipment and from which, when used, mineral cake is removed through a conduit 49. Solvent that is separated from the coal in the solvent still 47 flows in a conduit 51 back into the pump 35 and is then forced down the tubular conduit 15 again. The coal product that is separated from the solvent flows from the solvent still through a conduit 53 into other apparatus (not shown) available for processing the coal. In order to regulate the flow of solvent and coal in solution into the centrifuge 47, a valve 55 is provided in conduit 57 connecting conduit 39 and the centrifuge 47.

In some applications it is desirable to add hydrogen from a convenient source of supply 59 to the pump 35, which hydrogen mixes with the solvent recycle being pumped down the conduit 15. The hydrogen aids in the digestion or solution of the coal and it also prevents the coal from coking while being processed and handled in accordance with the invention.

In operation, it is desirable and necessary, in order to effect any solution of the coal in the seam, to bring the coal-solvent interface to a temperature of at least 250° C. (480° F.) and, preferably, to a temperature in the range of 300° – 400° C. (570° – 750° F.). At the higher end of the temperature scale, the rate of dissolving coal is greater than at the lower end of the temperature scale.

Also, it is desirable and necessary in order to contact as much surface of the coal with the solvents as possible, to fracture the coal seam in the vicinity of the conduits 15, 29 according to well-known conventional techniques. The drawing suggests such a fractured coal seam between the conduits 15, 29.

In accordance with the present invention, once the method has become operative, a certain amount of solvent and coal are, after heating, returned to the pump through conduit 37, and the balance of the solvent and coal are diverted through the centrifuge 47 and the still 43. Then, the recycle solvent is returned to the pump through the conduit 51.

A benefit derived from the method of the invention is that heat is brought rapidly to the coal seam face and the pumping action provides agitation that enhances dissolving the coal.

It is contemplated that as much as 85 to 95% or more coal can be dissolved in accordance with the method of the invention, depending upon the coal itself and the solvent used. However, in order to avoid pumping new viscous digestion, it is proposed to operate in the range of from 10 to 20% coal solution.

By using one tubular conduit 15 to inject the hot solvents into the coal seam, and the other conduit 25 to carry the coal solution to the surface and to separating equipment, a great deal of coal surface is exposed to the solvent which results in fast dissolution of the coal.

Further, in accordance with the present invention, there is a minumum loss of solvent, and even at the termination of production from a particular coal seam, the residual solvent can be recovered by chasing it out with steam or hot water.

It is known from the prior art to hydrogenate coal underground with a hydrogenating agent. The hydrogenation is carried out at an elevated temperature and pressure which may be controlled from above ground. The hydrogenation reaction produces a liquid product which is readily recovered as a relatively heavy oil that may be further treated to produce motor fuels and other desired products.

The prior art teaches using free hydrogen or an organic compound capable of liberating hydrogen. Hydroaromatic oils act as solvents in the liquefaction of coal due primarily to their ability to transfer hydrogen to the coal. A typical liquid product obtained by underground hydrogenation comprises 60 to 70% liquid hydrocarbons and 10 to 30% gaseous hydrocarbons.

In contrast to the known prior art teachings, the method of the present invention includes the extraction of the in situ coal by dissolving and not by liquefying. That is to say, the method of the present invention dissolves and extracts coal in almost its original form whereas the liquefying method known from the prior art extracts a liquid product, not coal, comprising the liquid and gaseous hydrocarbons mentioned previously.

In accordance with one aspect of the present invention, the solvent is an aromatic hydrocarbon or creosote or heavy oil. The molecular configuration of the aromatic solvent is important. Phenanthrene and other 3 and 4 angular member ring compounds, such as fluoranthene, pyrene and chrysene, and N-containing 3-membered ring aromatics, like carbazole and acridine are suitable as solvents. These solvents can dissolve 85 to 95% or more coal, while linear aromatics, such as anthracene and fluorene can dissolve less than 25% coal. For example, phenanthrene will dissolve up to 95% of the organic matter in coal, whereas anthracene will dissolve only 24%. For this reason, a middle oil fraction, having a boiling point between 325° and 400° C. is usually preferred. While tetralin has proven to be a good coal solvent, it acts as a hydrogen donor, reverting partially to naphthalene, and for this reason it is impractical commercially.

The solvent can be any one of the preferred compounds or their mixtures (eutectic composition preferably) and should be heated to above the melting point, or dissolved in a suitable carrier liquid such as heavy oil, using a minimum of 5% of the preferred solvent in the heavy oil.

Those skilled in the art also will understand that the amount of coal which can be dissolved depends on the rank of the coal as well as the molecular configuration of the solvent. Using the solvents mentioned previously herein, up to about 95% of the organic matter is dissolved, thus permitting the separation of mineral matter and fusain. A substantial portion of sulphur is concomitantly removed.

From the foregoing description of one embodiment of the invention, those skilled in the art should recognize many important features and advantages of it, among which the following are particularly significant:

That the solution mining method of the invention is relatively simple and much less costly than conventional coal mining;

That there is a significant saving in plant and equipment for extracting coal by such solution mining from underground seams;

That the undesirable environmental results of conventional coal mining, like refuse piles, refuse fires, washery air and water effluents, should be eliminated with adoption of the solution mining method of the invention;

That the coal seam, with proper care and technique, should be sealed during and after completion of the solution coal mining so that acid mine drainage, a result of conventional mining practice, should not be a serious problem;

That the solution mining method of the invention could replace conventional strip mining practice with its serious environmental damage; and That the personnel hazards of conventional coal mining are obviated by adoption of the solution mining method of the present invention.

Although the invention has been described herein with a certain degree of particularity, it is understood that the present disclosure has been made only as an example and that the scope of the invention is defined by what is hereinafter claimed.

What is claimed is:

1. A method for solution mining coal from seams beneath the earth's surface and the recovery of coal from solution comprising the steps of:

a. injecting a coal solvent heated to a temperature in the range of 250° – 400° C. into said coal seam whereby said coal goes into a coal solution;
b. removing said coal solution from said seam;
c. heating said coal solution,
d. diverting one portion of said heated coal solution into said coal solvent;
e. separating coal from the solvent in the other portion of said heated solution; and
f. recycling said separated solvent into said coal solvent.

2. The invention of claim 1 including the steps:

a. separating mineral matter from the other portion of said heated coal solution;
b. separating coal out of said coal solution; and
c. recycling the solvent into said coal solvent.

3. The invention of claim 1 including the step:

a. heating said coal solution to a temperature within the range of 250° – 400° C.

4. The invention of claim 3 wherein:

a. said solvent is selected from the group consisting of: phenanthrene, fluoranthene, pyrene, chrysene.

5. The invention of claim 3 wherein:

a. said solvent has an angular molecular configuration and is selected from the group consisting of carbazole and acridine; and
b. said solvent has a boiling point in the range of 325° – 400° C.

6. The method of claim 1 including the step of:

a. adding hydrogen to said coal solvent.

7. A method for solution mining coal from seams beneath the earth's surface and the recovery of coal from solution comprising the steps of:

a. injecting a coal solvent having an angular molecular configuration and selected from the group consisting of carbazole and acridine and a boiling point in the range of 325° – 400° C. into a coal seam whereby said coal goes into solution;
b. removing said coal solution from said seam;
c. heating the coal solution to a temperature in the range of 250° – 400° C.;
d. diverting one portion of said heated coal solution into a stream of said coal solvent;
e. separating mineral matter fom the other portion of said coal solution;
f. separating coal from the other portion of said coal solution; and
g. recycling the solvent into said coal solvent after removing the mineral matter and coal from the other portion of said coal solution.

8. The method of claim 7 including the step of:

a. adding hydrogen to said coal solvent

9. The method of claim 7 wherein:

a. said coal solvent is a heavy oil carrier including at least 5 percent of substance selected from the group consisting of carbazole and acridine.

10. The method of claim 7 wherein:

a. said coal solvent is a heavy oil carrier including at least 5 percent of substance selected from the group consisting of phenanthrene, fluoranthene, pyrene and chrysene.

* * * * *